US005147846A

United States Patent [19]

Harrison et al.

[11] Patent Number: 5,147,846

[45] Date of Patent: Sep. 15, 1992

[54] SURFACTANT FOR USE IN THERMAL DYE TRANSFER RECEIVING ELEMENT SUBBING LAYER

[75] Inventors: Daniel J. Harrison, Pittsford; Michael W. Orem, Rochester; Michael J. Corrigan, Hilton, all of N.Y.

[73] Assignee: Eastman Kodak Company, Rochester, N.Y.

[21] Appl. No.: 658,117

[22] Filed: Feb. 20, 1991

Related U.S. Application Data

[63] Continuation-in-part of Ser. No. 632,295, Dec. 21, 1990, abandoned.

[51] Int. Cl.[5] ..... B41M 5/035; B41M 5/26

[52] U.S. Cl. ..... 503/227; 427/146; 427/148; 428/195; 428/341; 428/447; 428/500; 428/522; 428/913; 428/914

[58] Field of Search ..... 427/146, 148; 428/195, 428/341, 447, 500, 522, 913, 914; 503/227

[56] References Cited

U.S. PATENT DOCUMENTS

| | | | |
|---|---|---|---|
| 4,734,397 | 3/1988 | Harrison et al. | 503/227 |
| 4,748,150 | 5/1988 | Vanier et al. | 503/227 |
| 4,833,124 | 5/1989 | Lum | 503/227 |

FOREIGN PATENT DOCUMENTS

| | | | |
|---|---|---|---|
| 1229951 | 4/1971 | United Kingdom | 503/227 |

*Primary Examiner*—B. Hamilton Hess
*Attorney, Agent, or Firm*—Andrew J. Anderson

[57] ABSTRACT

A process for manufacturing a dye-receiving element for thermal dye transfer comprising coating a cushion intermediate layer, a subbing layer, and a dye image-receiving layer on a support, wherein the cushion layer and subbing layer are simultaneously coated, and wherein the subbing layer includes a hydroxylated siloxane polymer surfactant having random recurring units of the following structures I or II:

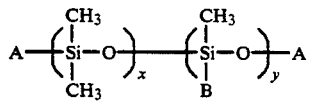

(I)

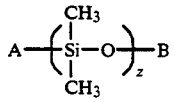

(II)

wherein A is —$CH_3$ or B, and B is a $C_1$ to $C_{10}$ straight chain or branched primary or secondary hydroxy terminated alkylene group, and x, y, and z are such as to provide a molecular weight of from about 1,000 to about 20,000 and from 1 to about 20 hydroxyl groups per polymer molecule. The invention further comprises a receiving element comprising a support having thereon a cushion intermediate layer, a dye image-receiving layer, and a subbing layer between the cushion layer and the dye image-receiving layer, wherein the subbing layer contains a surfactant of the above structures I or II.

20 Claims, No Drawings

SURFACTANT FOR USE IN THERMAL DYE TRANSFER RECEIVING ELEMENT SUBBING LAYER

CROSS REFERENCE TO RELATED APPLICATIONS

This application is continuation in part of copending U.S. application Ser. No. 07/632,295 filed Dec.21, 1990, now abandoned.

TECHNICAL FIELD

This invention relates to dye-receiving elements used in thermal dye transfer, and more particularly to receiving elements having a subbing layer coated with a surfactant between a cushion intermediate layer and a dye image-receiving layer.

BACKGROUND

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in Brownstein U.S. Pat. No. 4,621,271 entitled "Apparatus and Method For Controlling A Thermal Printer Apparatus," issued Nov. 4,1986, the disclosure of which is hereby incorporated by reference.

Dye-receiving elements used in thermal dye transfer generally comprise a polymeric dye image-receiving layer coated on a support. A compression, or cushion intermediate layer, for example as taught by Harrison et al. in U.S. Pat. No. 4,734,397, may also be present between the support and the dye image-receiving layer. Such cushion layers promote better contact between a dye-donor element and the dye image-receiving element, which minimizes the formation of image defects during dye transfer and improves the scratch resistance of the receiving element. Further, subbing layers, for example as taught by Vanier et al. in U.S. Pat. No. 4,748,150, may also be present between the various layers in order to promote adhesion.

When a cushion layer is used between the receiver support and dye image receiving layer, and a subbing layer is also used between the cushion layer and the dye image-receiving layer, it is highly desirable to be able to coat the cushion and subbing layers simultaneously in one operation from miscible ketone based solvents rather than in a multiple coating-drying-coating-drying cycle in order to most efficiently manufacture the receiving element. It has been found, however, that simultaneous coating of cushion layers such as polyalkylacrylate esters and subbing layers such as vinylidene chlorides and polyvinyl acetate results in severe layer thickness nonuniformities in the coated layers due to formation of crater shaped repellancy spots, even when using miscible coating solvents such as butanone and acetone. Further, while the use of surfactants which lower the surface tension of such ketone solvents would be expected to facilitate coating, use of many of such known surfactants were found to still result in unacceptable coatings.

As such, it would be desirable to provide a manufacturing process which would enable the simultaneous coating of cushion layers and subbing layers on a support for a thermal dye transfer receiving element without a significant level of nonuniformities in the resulting coated layers.

SUMMARY OF THE INVENTION

These and other objects of the invention are achieved in accordance with this invention which comprises a process for manufacturing a dye-receiving element for thermal dye transfer comprising coating a cushion intermediate layer, a subbing layer, and a dye image-receiving layer on a support, wherein the cushion layer and subbing layer are simultaneously coated, and wherein the subbing layer includes a hydroxylated siloxane polymer surfactant having random recurring units of the following structures I or II:

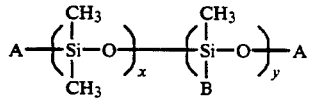

(I)

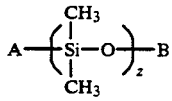

(II)

wherein A is —$CH_3$ or B, and B is a $C_1$ to $C_{10}$ straight chain or branched primary or secondary hydroxy terminated alkylene group, and x, y, and z are such as to provide a molecular weight of from about 1,000 to about 20,000 and from 1 to about 20 hydroxyl groups per polymer molecule.

The invention further comprises a receiving element comprising a support having thereon a cushion intermediate layer, a dye image-receiving layer, and a subbing layer between the cushion layer and the dye image-receiving layer, wherein the subbing layer contains a surfactant of the above structures I or II.

It has surprisingly been found that use of the above hydroxylated siloxane polymer surfactants enable the simultaneous coating of cushion layers and subbing layers from ketone based solvents without substantial nonuniformities. Other known surfactants, which while known to lower the surface tension of ketone solvents, are ineffective.

DETAILED DESCRIPTION

For the purposes of this invention, "simultaneously coating" is intended to describe the coating of multiple layers without separately drying the individual layers. Simultaneous multilayer coating technology is well known, and the techniques and apparatus set forth in U.S. Pat. Nos. 2,761,791, 2,941,898, 3,206,323, 3,425,857, 3,508,947, 3,645,773, 4,001,024, 4,154,879, 4,233,346, 4,283,443, 4,287,240, 4,297,396, 4,490,418, and 4,572,849, the disclosures of which are incorporated by reference, may be employed.

The support for the dye-receiving element of the invention may be a transparent film such as a poly(ether sulfone), a polyimide, a cellulose ester such as cellulose acetate, a poly(vinyl alcohol-coacetal) or a poly(ethylene terephthalate). The support may also be reflective such as white polyester (polyester with white pigment incorporated therein), or polyolefin coated paper. The use of cushion layers is particularly advantageous when a plastic film support is used. The support may be any desired thickness, depending upon the desired end use of the receiving element. In general, polymeric supports are usually from about 3 μm to about 200 μm and paper supports are generally from about 50 μm to about 1000 μm.

The cushion (or compression) layer may be, for example, any of the materials described in U.S. Pat. No. 4,734,397, the disclosure of which is incorporated by reference, which are coatable in a ketone based solvent. Such cushion layers are coated at a coverage of at least 2.0 g/m$^2$, and have a compression modulus of less than 350 mega Pascals ($10^6$ Pascals). In a preferred embodiment, a polyalkyl acrylate ester cushion layer, such as a poly(n-butyl acrylate-co-acrylic acid) cushion layer, is used. Preferably, such copolymers comprise from about 30 to about 60 wt.% alkyl acrylate component and from about 70 to about 40 wt.% acrylic acid component. A first subbing layer may be coated on the support before coating the cushion layer, if desired, to improve adhesion between the cushion layer and the support.

The subbing layer to be coated simultaneously with and on top of the cushion layer may be any known subbing layer which is coatable from a ketone based solvent. Such subbing layers include, for example, polyvinylidene chloride derived subbing layers as described by Vanier et al. in U.S. Pat. No. 4,748,150, the disclosure of which is incorporated by reference, and polyvinyl acetate subbing layers. In a preferred embodiment, a vinylidene chloride comprising from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride is used for the subbing layer. Most preferably, the subbing layer comprises from about 5 to about 35 percent by weight of acrylonitrile, from about 2 to about 10 percent by weight of acrylic acid, and from about 55 to about 85 percent by weight of recurring units of vinylidene chloride as described in U.S. Pat. No. 4,748,150.

The subbing layer of the invention may be employed at any concentration which is effective for the intended purpose. In general, good results are achieved at from about 0.03 to about 1 g/m$^2$ of coated element.

The cushion layer and subbing layer which are coated simultaneously must be coatable from miscible solvents. Ketone based solvents have been found to be suitable for coating a variety of cushion layers and subbing layers, and are environmentally preferable to other solvents such as chlorinated solvents. Representative examples of such ketone based solvents include butanone, acetone, 4-methyl-2-pentanone, and cyclohexanone. These solvents may also be admixed with water and alcohols such as methanol to form acceptable solvent mixtures.

As set forth above, surfactants of structure I or II are used in the present invention:

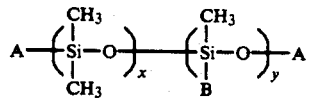

(I)

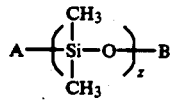

(II)

wherein A is —$CH_3$ or B, and B is a $C_1$ to $C_{10}$ straight chain or branched primary or secondary hydroxy terminated alkylene group. Examples of B include —$CH_2OH$, —$CH_2CH_2OH$, —$CH(CH_3)OH$, —$CH(CH_3)CH_2OH$, —$CH_2CH(OH)CH_3$, —$CH(CH_3)CH_2CH(OH)CH_3$, —$(CH_2)_4CH(OH)CH_3$, —$(CH_2)_6OH$, —$(CH_2)_{10}OH$, etc. Examples of materials according to structures I and II include:

I-1: Dow Corning 1248, described by the manufacturer as an organofunctional silicone fluid. It is structurally considered to have units of:

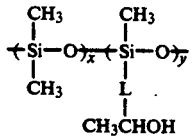

where L is a $(CH_2)_{1-4}$ linking group. The molecule contains multiple secondary alcohol groups branched off the polymer backbone. Estimated MW=6000.

II-1: Dow Corning Q4-3667, described by the manufacturer as a hydroxyalkyl-terminated polydimethyl siloxane. It is structurally considered to have units of:

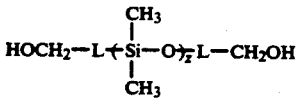

where L is a $(CH_2)_{1-4}$ linking group. The molecule contains primary alcohol terminal groups on the polymer backbone. Estimated MW=2400.

The surfactants of the invention are considered effective above about 0.002 g/m$^2$, and are preferably used at or above about 0.016 g/m$^2$. Generally, the amount of surfactant to be used will depend upon the coating level of the subbing layer, as it is preferable to use the surfactant at from about 0.1 to about 1 percent of the weight of the subbing layer, and at from about 0.05 to about 0.3 weight percent of the coating solution.

After coating of the cushion layer and the subbing layer, a dye image receiving layer is coated. The dye image-receiving layer of the receiving elements of the invention may comprise, for example, a polycarbonate, a polyurethane, a polyester, polyvinyl chloride, poly(styrene-co-acrylonitrile), poly (caprolactone) or mixtures thereof. The dye image-receiving layer may be present in any amount which is effective for the intended purpose. In general, good results have been obtained at a concentration of from about 1 to about 5 g/m$^2$. In a preferred embodiment of the invention, the dye image-receiving layer is a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl) propane, bis(4-oxyphenyl)methane, 1,1-bis(4-oxyphenyl) ethane, 1,1-bis-(oxyphenyl)butane, 1,1-bis(oxyphenyl) cyclohexane, 2,2-bis(oxyphenyl)butane, etc. In a particularly preferred embodiment, a bisphenol-A polycarbonate having a number average molecular weight of at least about 25,000 is used. Examples of preferred polycarbonates include General Electric LEXAN® Polycarbonate Resin and Bayer AG MACROLON 5700®. Further, an overcoat polymer as described in U.S. Pat. No. 4,775,657 may also be used.

A dye-donor element that is used with the dye-receiving element of the invention comprises a support having thereon a dye containing layer. Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine R® (product of Nippon Kayaku Co. Ltd.); basic dyes such as Sumicacryl Blue 6G® (product of Sumitomo Chemical Co. Ltd.), and Aizen Malaohite Green® (product of Hodoqaya Chemical Co., Ltd.);

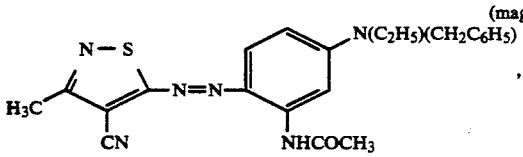

(magenta)

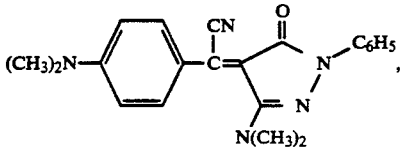

(magenta)

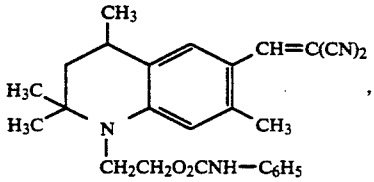

(yellow)

-continued

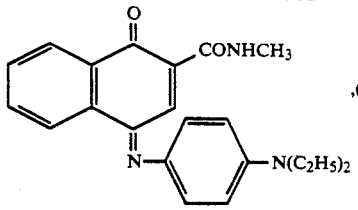

,(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogenphthatate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

The reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly (caprolactone), poly(oxyethylenes) or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of from about 0.001 to about 2 g/m$^2$. If a polymeric binder is employed, the lubricating material is present in the range of 0.1 to 50 weight %, preferable 0.5 to 40 weight %, of the polymeric binder employed.

As noted above, the dye-donor elements and receiving elements of the invention are used to form a dye transfer image. Such a process comprises imagewise-heating a dye-donor element as described above and transferring a dye image to a dye-receiving element to form the dye transfer image.

The dye-donor element may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. 4,541,830. Thus, one-, two- three- or four-color elements (or higher numbers also) are included within the scope of the invention.

In a preferred embodiment, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements to the receiving elements are available commercially. There can be employed, for example, a Fujitsu Thermal Head (FTP-040 MCSOOl), a TDK Thermal Head F415 HH7-1089 or a Rohm Thermal Head KE 2008-F3.

A thermal dye transfer assemblage of the invention comprises: a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to help further illustrate the invention.

EXAMPLE 1

A subbing layer of poly(acrylonitrile-covinylidene chloride-co-acrylic acid)(14:79:7 wt ratio) (0.05 g/m$^2$) was coated on a 175 um thick poly(ethylene terephthalate) support. After drying, this coated support was used for simultaneously coating of a cushion layer of poly(n-butyl acrylate-co-acrylic acid) (50:50 wt ratio)(8.1 g/m$^2$) from an acetone and water solvent and a second subbing layer of poly(acrylonitrile-covinylidene chloride-co-acrylic acid)(14:79:7 wt ratio) (0.54 g/m$^2$) and siloxane I-1 or II-1 (either at 0.005, 0.016, or 0.032 g/m$^2$) from a butanone solvent. Each coated support was then dried at 71° C. for 5 min. The following comparison siloxanes were also evaluated in place of siloxanes I-1 and II-1:

C-2: Dow Corning 531, described by the manufacturer as an amino reactive silicone. It is structurally considered to have units of:

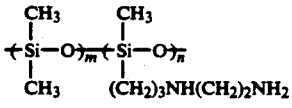

containing multiple seconday amine groups within the polymer backbone. Estimated MW=2400

C-3: Dow Corning 510, described by the manufacturer as a partially phenyl substituted polydimethylsiloxane. It is structurally considered to have units of:

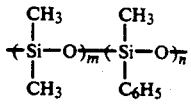

containing no polar groups within the polymer backbone or as terminal units. The fluid specifically tested had a viscosity of 50 centistokes.

C-4 to C-8: Union Carbide L-7000 Series Silwets, described by the manufacturer as a series of polyalkyleneoxide grafted methyl terminated polydimethylsiloxane surfactants of different viscosity. They are structurally considered to have units of:

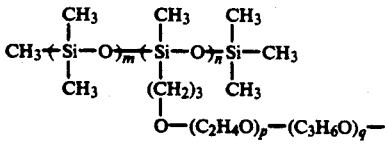

containing multiple oxyethylene and oxypropylene groups on side chains branched off the polymer backbone.

C-4: Silwet L-7000, viscosity 750 cts (@ 25° C.)
C-5: Silwet L-7004, viscosity 1200 cts (@ 25° C.)
C-6: Silwet L-7604, viscosity 350 cts (@ 25° C.)
C-7: Silwet L-7605, solid at 25° C.
C-8: Silwet L-7610, viscosity 140 cts (@ 25° C.)

C-9: General Electric SF-1023, described by the manufacturer as a partially phenyl substituted polydimethylsiloxane. It is structurally considered to have units of:

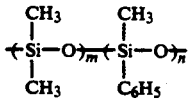

After coating and drying, each sample was examined for nonuniformities using a small magnifier. Three categories of nonuniformities were established and coatings were classified for repellencies as:

(S) Severe: Greater than 5% of the total area contained 1-10 mm size crater shaped repellancy spots void of coated material.

(M) Moderate About 1% to 5% of total area containing repellancy spots.

(N) Negligible: Under 1% of total area containing repellancy spots.

The following results were obtained (Table I):

TABLE I

| Siloxane in Second Subbing Layer | Nonuniformities of Given Siloxane Level | | |
|---|---|---|---|
| | 0.005 g/m$^2$ | 0.016 g/m$^2$ | 0.032 g/m$^2$ |
| I-1: Secondary Alcohol Branched Siloxane | N | N | N |
| II-1: Primary Alcohol Terminated Siloxane | M | N | N |
| C-1: None (Control) | * | * | * |
| C-2 (Comparison) | M | M | M |
| C-3 (Comparison) | N | M | S |
| C-4 (Comparison) | S | S | S |
| C-5 (Comparison) | S | M | M |
| C-6 (Comparison) | S | S | S |
| C-7 (Comparison) | S | S | S |
| C-8 (Comparison) | S | S | S |

TABLE I-continued

| Siloxane in Second Subbing Layer | Nonuniformities of Given Siloxane Level | | |
|---|---|---|---|
| | 0.005 g/m² | 0.016 g/m² | 0.032 g/m² |
| C-9 (Comparison) | M | M | M |

*Totally irregular surface

The above results show the hydroxylated siloxanes are superior to other siloxanes for producing coatings with minimal nonuniformities, particularly when coated at 0.016 g/m² and higher.

EXAMPLE 2

Simultaneous coatings of poly(n-butyl acrylate-co-acrylic acid) cushion layers from an acetone and water solvent and second subbing layers containing siloxane I-1 from a butanone solvent were made as described in Example 1, except polyvinyl acetate (0.11 g/m²) was used for the second subbing layer in place of the vinylidene chloride derived polymer. The following comparison materials were also evaluated in place of siloxane I-1:

C-3: As in Example 1.

C-10: Union Carbide Silwet L-7001, structurally related to C-4 to C-8, viscosity 2000 cts @ 25° C.

C-11: 3M Corp. Fluorad FC-430, described by the manufacturer as a perfluorinated alkyl polymeric ester.

Each coating was dried at 55° C. for 5 minutes and evaluated as in Example 1. The following results were obtained (Table II):

TABLE II

| Siloxane in Second Subbing Layer | Nonuniformities at Given Siloxane Level | |
|---|---|---|
| | 0.002 g/m² | Other Level |
| II-1: Secondary Alcohol Branched Siloxane | N | — |
| C-3 (Comparison) | S | S (0.004 g/m²) |
| C-10 (Comparison) | S | S (0.004 g/m²) |
| C-11 (Comparison) | S | S (0.008 g/m²) |

The above results show that hydroxylated siloxanes minimize repellency nonuniformities for other subbing layers in addition to vinylidene chloride derived subbing layers when simultaneously coated with a cushion layer.

The invention has been described in detail with particular reference to preferred embodiments thereof, but it will be understood that variations and modifications can be effected within the spirit and scope of the invention.

What is claimed is:

1. A process for manufacturing a dye-receiving element for thermal dye transfer comprising coating a cushion intermediate layer, a subbing layer, and a dye image-receiving layer on a support, wherein the cushion layer and subbing layer are simultaneously coated from ketone based solvents, and wherein the subbing layer includes a hydroxylated siloxane polymer surfactant having random recurring units of the following structures I or II:

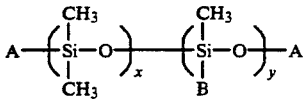

(I)

-continued

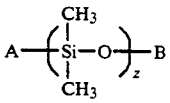

(II)

wherein A is —$CH_3$ or B, B is a $C_1$ to $C_{10}$ straight chain or branched primary or secondary hydroxy terminated alkylene group, and x, y, and z are such as to provide from 1 to about 20 hydroxyl groups per polymer molecule and a molecular weight of from about 1,000 to about 20,000.

2. The process of claim 1 wherein B is —$CH_2OH$, —$CH_2CH_2OH$, —$CH(CH_3)OH$, —$CH(CH_3)CH_2OH$, —$CH_2CH(OH)CH_3$, —$CH(CH_3)CH_2CH(OH)CH_3$, —$(CH_2)_4CH(OH)CH_3$, —$(CH_2)_6OH$, or —$(CH_2)_{10}OH$.

3. The process of claim 1 wherein the siloxane surfactant is present at from about 0.1 to about 1% of the weight of the subbing layer.

4. The process of claim 1 wherein the cushion layer is coated at a coverage of at least 2.0 g/m², and has a compression modulus of less than 350 mega Pascals.

5. The process of claim 4 wherein the subbing layer comprises from about 5 to about 35 percent by weight of acrylonitrile, from about 2 to about 10 percent by weight of acrylic acid, and from about 55 to about 85 percent by weight of recurring units of vinylidene chloride.

6. The process of claim 1 wherein the cushion layer comprises a poly(n-butyl acrylate-co-acrylic acid) containing from about 30 to about 60 wt.% butyl acrylate component and from about 70 to about 40 wt.% acrylic acid component.

7. The process of claim 6 wherein the subbing layer comprises from about 5 to about 35 percent by weight of acrylonitrile, from about 2 to about 10 percent by weight of acrylic acid, and from about 55 to about 85 percent by weight of recurring units of vinylidene chloride.

8. The process of claim 1 wherein the subbing layer comprises a vinylidene chloride comprising from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride.

9. The process of claim 1 wherein the subbing layer comprises from about 5 to about 35 percent by weight of acrylonitrile, from about 2 to about 10 percent by weight of acrylic acid, and from about 55 to about 85 percent by weight of recurring units of vinylidene chloride.

10. The process of claim 9 wherein the siloxane surfactant is present at from about 0.1 to about 1% of the weight of the vinylidene chloride subbing layer.

11. A receiving element for thermal dye transfer comprising a support having thereon a cushion layer, a dye image-receiving layer, and a subbing layer between the cushion layer and the dye image-receiving layer, wherein the subbing layer includes a hydroxylated siloxane polymer surfactant having random recurring units of the following structures I or II:

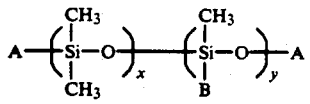

(I)

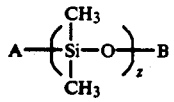

(II)

wherein A is $—CH_3$ or B, B is a $C_1$ to $C_{10}$ straight chain or branched primary or secondary hydroxy terminated alkylene group, and x, y, and z are such as to provide from 1 to about 20 hydroxyl groups per polymer molecule and a molecular weight of from about 1,000 to about 20,000.

12. The element of claim 11 wherein B is $—CH_2OH$, $—CH_2CH_2OH$, $—CH(CH_3)OH$, $—CH(CH_3)CH_2OH$, $—CH_2CH(OH)CH_3$, $—CH(CH_3)CH_2CH(OH)CH_3$, $—(CH_2)_4CH(OH)CH_3$, $—(CH_2)_6OH$, or $—(CH_2)_{10}OH$.

13. The element of claim 11 wherein the cushion layer is coated at a coverage of at least 2.0 $g/m^2$, and has a compression modulus of less than 350 mega Pascals.

14. The element of claim 13 wherein the subbing layer comprises a vinylidene chloride comprising from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride.

15. The element of claim 11 wherein the cushion layer comprises a poly(n-butyl acrylate-co-acrylic acid) containing from about 30 to about 60 wt.% butyl acrylate component and from about 70 to about 40 wt.% acrylic acid component.

16. The element of claim 15 wherein the subbing layer comprises a vinylidene chloride comprising from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride.

17. The element of claim 15 wherein the subbing layer comprises from about 5 to about 35 percent by weight of acrylonitrile, from about 2 to about 10 percent by weight of acrylic acid, and from about 55 to about 85 percent by weight of recurring units of vinylidene chloride.

18. The element of claim 11 wherein the subbing layer comprises a vinylidene chloride comprising from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride.

19. The element of claim 11 wherein the subbing layer comprises from about 5 to about 35 percent by weight of acrylonitrile, from about 2 to about 10 percent by weight of acrylic acid, and from about 55 to about 85 percent by weight of recurring units of vinylidene chloride.

20. The element of claim 19 wherein the siloxane surfactant is present at from about 0.1 to about 1% of the weight of the subbing layer.

* * * * *